United States Patent [19]

O'Brien

[11] 3,979,969

[45] Sept. 14, 1976

[54] CONTROLLED RELEASE MECHANISM FOR RAILWAY HAND BRAKE

[75] Inventor: Raymond A. O'Brien, Forest Park, Ill.

[73] Assignee: Cleveland Hardware & Forging Co., Cleveland, Ohio

[22] Filed: Aug. 26, 1974

[21] Appl. No.: 500,728

[52] U.S. Cl. ..... 74/505; 188/134; 188/187

[51] Int. Cl.[2] ..... G05G 1/08

[58] Field of Search ..... 74/505; 188/134, 187; 185/2

[56] References Cited

UNITED STATES PATENTS

| | | | |
|---|---|---|---|
| 419,051 | 1/1890 | Lester | 185/2 |
| 3,173,305 | 3/1965 | Mersereau | 74/505 |
| 3,367,598 | 2/1968 | Harrington et al. | 188/187 |
| 3,433,332 | 3/1969 | Braun | 188/134 |

*Primary Examiner*—Samuel Scott
*Assistant Examiner*—Wesley S. Ratliff, Jr.
*Attorney, Agent, or Firm*—Lockwood, Dewey, Zickert & Alex

[57] ABSTRACT

Kinetic energy incident to the trip release and consequent rapid spinning and unwinding of rotating members in a chain operated railway car hand brake mechanism is substantially dissipated by energy absorbing means which frictionally engage the rapidly rotating members. The frictional engagement slows down the rotation of the members thus decreasing the shock to the members as they are rapidly stopped when the mechanism reaches full release. The rotation stoppage of the members is necessary to prevent the mechanism from winding in the wrong direction and thereby damaging the hand brake mechanism and brake components at opposite ends of the chain.

5 Claims, 6 Drawing Figures

FIG. 3
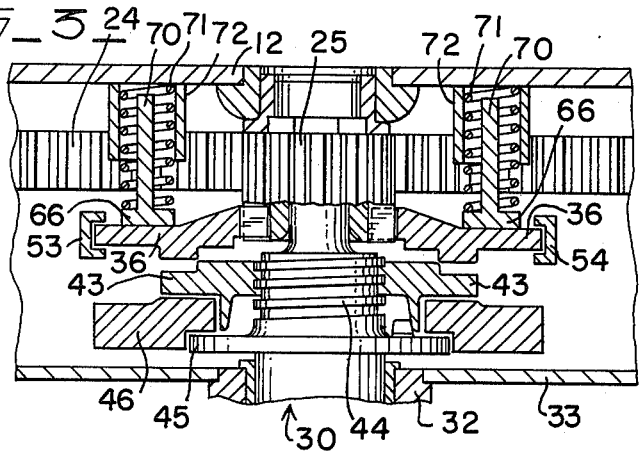
FIG. 4
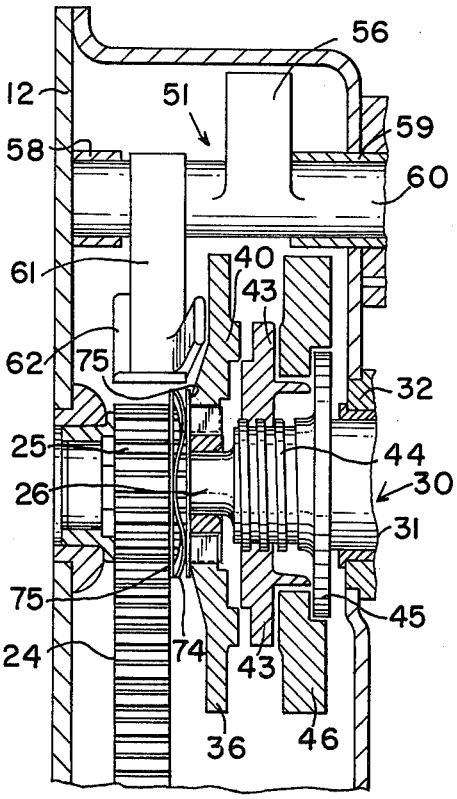
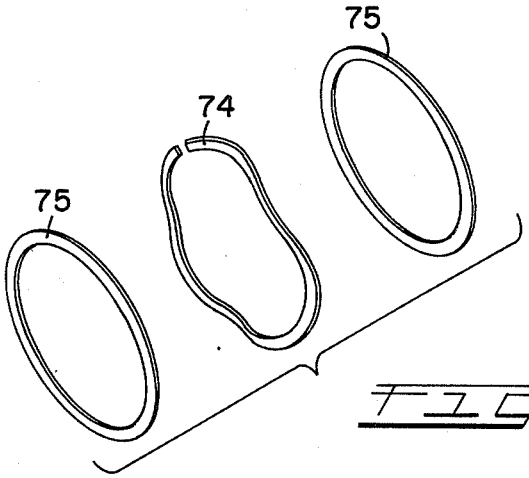
FIG. 6
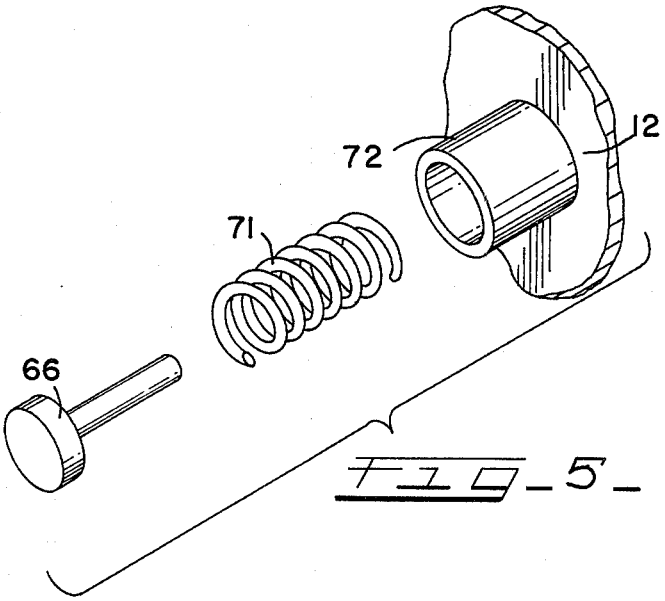
FIG. 5

CONTROLLED RELEASE MECHANISM FOR RAILWAY HAND BRAKE

This invention relates generally to hand brake mechanisms for railway cars and it constitutes an improvement in hand brake constructions of the type disclosed in Frank E. Bretz, Jr., U.S. Pat. No. 3,040,597, issued June 26, 1962 and William F. Koehler, U.S. Pat. No. 3,714,842, issued Feb. 6, 1973.

The above patents disclose a hand brake mechanism for railway cars in which a chain connected to the brake rigging is wound under tension on a chain winding drum so as to apply the brakes. Provision is made for quickly releasing the tension of the chain to release the brakes. This release is accompanied by a rapid reverse rotation of the drum. As the drum reaches full release position, a portion of the chain attached thereto strikes a rigid chain stop mounted on the wall of the housing. The brake mechanism is thereby prevented from winding in a reverse direction on the drum. Incremental damage to the links of the chain and other parts of the brake mechanism due to the shock incident to both starting and stopping the rapid reverse rotation of the drum may eventually necessitate replacement of parts in the mechanism.

The invention is an improvement comprising energy absorbing means for slowing the rotation of spinning members of the mechanism as the brake is released.

An object of this invention is to provide means for substantially dissipating the energy incident to the rapid spinning and unwinding of rotating members in a chain operated car hand brake mechanism in a new and improved manner.

Another object of this invention is to provide frictional means for impinging against said unwinding members, thereby slowing their rotation and decreasing the shock of the rapid stoppage of rotation when the brake reaches full release position.

Other objects, features and advantages of the invention will be apparent from the following detailed disclosure, taken in conjunction with the accompanying drawings, wherein like reference numerals refer to like parts, in which:

FIG. 3 is a fragmentary cross-sectional view similar to FIG. 2 with the radially extending flange retracted to engage the energy absorbing pads of the invention;

FIG. 4 is a fragmentary cross-sectional view taken along line 4—4 of FIG. 1 showing a second embodiment of the invention frictionally engaged between the radially extending flange and the main gear wheel;

FIG. 5 is an exploded perspective view of the frictional pad mechanism of the invention resiliently held in a retainer in the back plate of the hand brake mechanism; and FIG. 6 is an exploded perspective of the wave washer mechanism of the invention and two flat washers on either side thereof.

Figure 1:
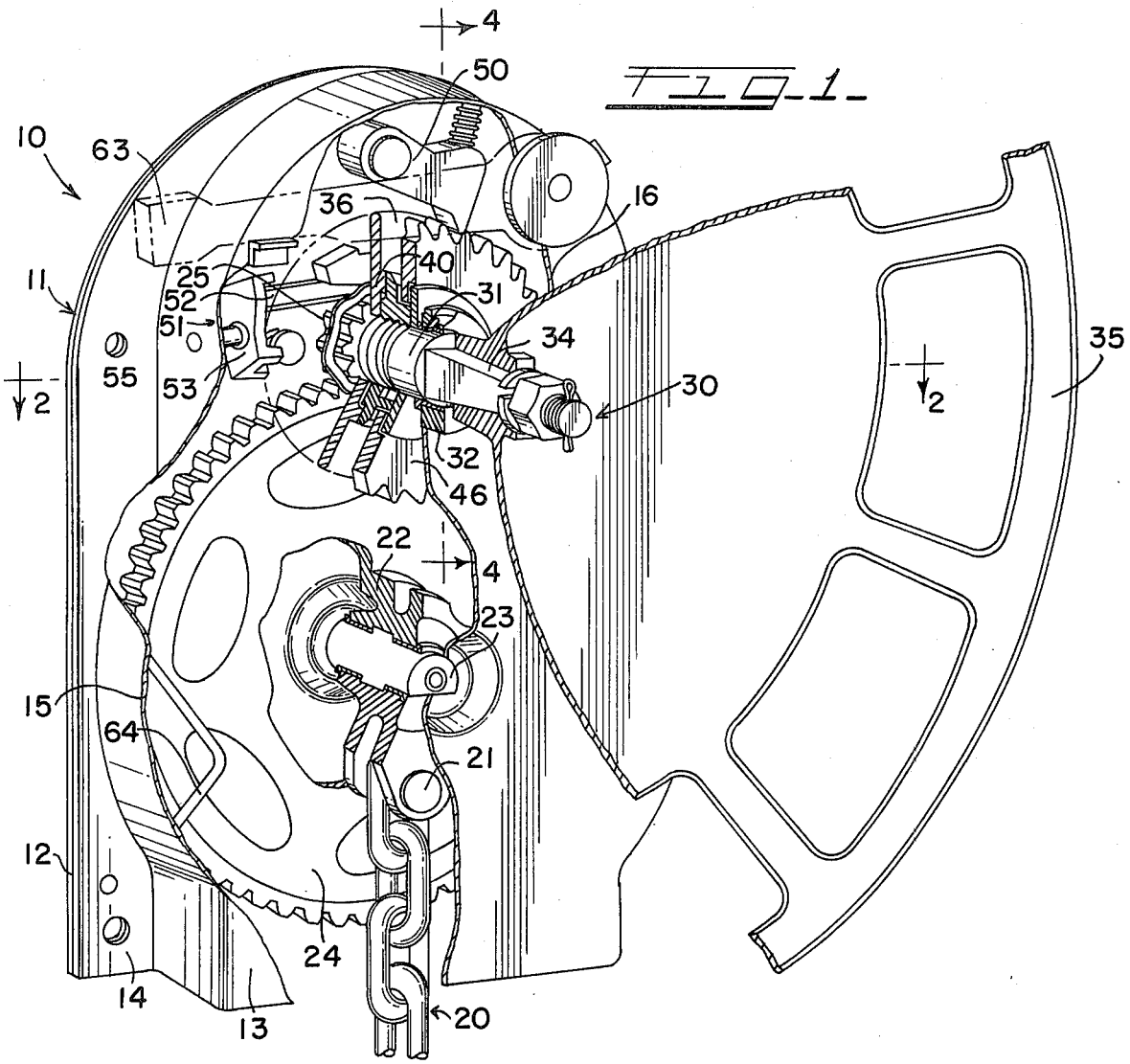
FIG. 1 is a perspective view of a railway hand brake mechanism with portions broken away to show the energy absorbing means of the invention.

In FIG. 1 the reference character 10 designates, generally, a hand brake mechanism of the kind and character disclosed in the above patents but modified in accordance with this invention. The hand brake mechanism 10 includes a metallic case or housing 11, which is made up of a back plate 12 and a cover 13 which is provided with an outturned flange 14 overlying the outer margin of the back plate 12 and suitably secured thereto for suitable mounting on a railroad car. The cover 13 is provided with sidewalls 15 and 16.

For applying and releasing the brakes there is provided a chain, shown generally at 20, that is connected at one end to the brakes (not shown) and at its other end to the brake mechanism in known manner such as by pin 21. For applying or setting the brakes chain 20 is wound on a chain winding drum 22 that is journaled on a shaft 23. A main gear wheel 24 suitably connected to or integral with drum 22 is arranged to be driven by a pinion 25 which is freely rotatably mounted on a reduced diameter section 26 (FIG. 4) of a hand wheel shaft that is indicated, generally at 30. At its rear the hand wheel shaft 30 is suitably journaled on the back plate 12. It has a bearing portion 31 near its front end which is journaled in a bushing 32 that is mounted on the front wall 33 of the cover 13. At the outer end of the hand wheel shaft 30 there is a tapered hand wheel receiving section 34 with four flat sides on which a hand wheel 35 is nonrotatably mounted.

In order to provide a driving connection between the hand wheel 35 and the pinion 25, the latter has a radially extending flange 36 slidably splined thereon and rotatable conjointly therewith. Lugs 40 formed integrally with the radially extending flange 36 project axially into slots 41 which are formed in a juxtaposed face 42 of a pressure nut 43 which is mounted on a threaded section 44 of the hand wheel shaft 30. The mating lug and slot arrangement is shown and described more fully in the above-mentioned Bretz patent. A brake flange 45 is integral with the hand wheel shaft 30 and located between it and the pressure nut 43 is a ratchet wheel 46. The ratchet wheel 46 is prevented from reverse rotation by a pawl 50.

For applying the brakes, the hand wheel 35 is rotated in a clockwise direction as viewed in FIG. 1, thereby rotating ratchet wheel 46 in a clockwise direction and the main gear wheel 24 and chain drum 22 in a counter-clockwise direction as indicated by arrows thereon. Since considerable tension is applied to the chain 20 there will be some resistance to rotation by the pinion 25 and the pressure nut 43. The rotation of the hand wheel 35 and hand wheel shaft 30 against this tension causes the pressure nut 43 to rotate slightly along the threaded section 44. As a result, the ratchet wheel 46 is clamped between the pressure nut 43 and the brake flange 45. As long as the radially extending flange 36 maintains its lug-slot mechanical connection to the pressure nut 43, the driving connection to the pinion 25 is maintained. Reverse rotation is prevented by the pawl 50.

Figure 2:
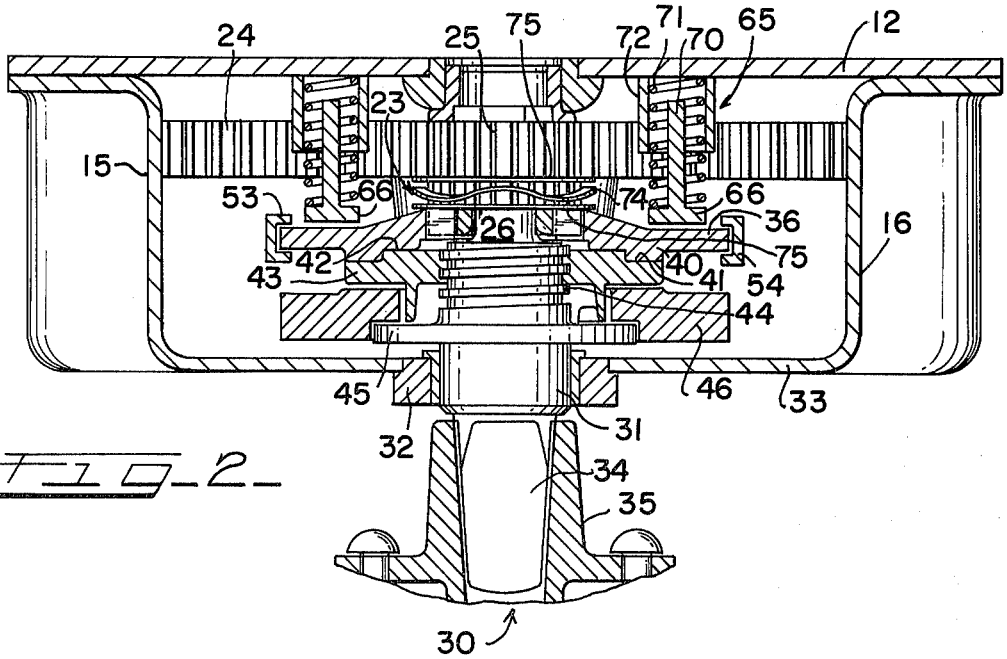
FIG. 2 is a cross-sectional view of the railway hand brake mechanism taken along line 2—2 of FIG. 1.

In order to quickly release the brakes the driving connection between the hand wheel shaft 30 and the pinion 25 is interrupted by shifting the radially extending flange 36 out of the lug-slot mechanical engagement with the pressure nut 43. This is accomplished through the provision of trip bar means of known type indicated, generally at 51 in FIGS. 1 and 4. The trip bar means 51 comprises a tie bar 52 to the ends of which levers 53 and 54 (FIG. 2) are secured. As shown in FIG. 2, jaws at the distal ends of the levers 53 and 54 are arranged, as described in more detail in the above patents, to engage opposite sides of the radially extendingg flange 36 for shifting it into and out of engagement with the pressure nut 43 for controlling the driving arrangement between the hand wheel shaft 30 and the pinion 25. Coil compression springs (not shown) are interposed in known manner between the back plate 12 and the jaws of the levers 53 and 54 and are effective to bias the radially extending flange 36 into driving engagement with the pressure nut 43. The ends of the trip bar means 51 are suitably journaled on sidewalls 15 and 16 as shown at 55. The pivotal mounting may be as disclosed in the above Koehler patent, or other known designs.

For manually shifting the trip bar means 51 to trip the radially extending flange 36 from driving engagement with the pressure nut 43, a lever 54 is provided with a lever arm (not shown) that is engaged by a cam arm 56 as shown in FIG. 4 that extends radially from a cam shaft 60. The rear end of the cam shaft 60 is journaled on the back plate 12 in a sleeve 58 and the front end is journaled on the front wall 53 in a sleeve 59. A safety arm 61 extends radially from the cam shaft 60 and is provided with a flared end 62 for preventing inadvertent disengagement of the radially extending flange 36 from driving engagement with the pressure nut 43.

The forward end of cam shaft 60 extends through the front wall 33 of the cover 13 where a manually operable trip lever 63 shown in broken outline in FIG. 1 is mounted thereon. As shown, the trip lever 63 occupies a horizontal position. It may have a lost motion connection to the cam shaft 60. On pivotal movement of the cam shaft 60 in a clockwise direction by the trip lever 63, the flared end 62 of the safety arm 61 is moved out of the path of the radially extending flange 36 while the cam arm 56 engages the lever arm (not shown) to pivot the trip bar means 40. Through the jaws of the levers 53 and 54 the radially extending flange 36 is moved laterally of the pinion 25 and out of mechanical engagement with the pressure nut 43. While the pawl 50 continues to prevent reverse rotation of the ratchet wheel 46, pinion 25, gear wheel 24, and drum 22 rotate freely and the chain 20 is permitted to unwind rapidly from the chain winding drum 22 to effect an immediate, full, and complete, release of the brakes.

Since the chain 20 is under considerable tension when it is wound on the chain winding drum 22, there is substantial shock to the entire hand brake mechanism 10 when the trip lever 63 releases that tension. Thus, the radially extending flange 36, the pinion 25, main gear wheel 24, and chain winding drum 22 are accelerated into very rapid rotation when the trip lever is released. A second substantial shock to the hand brake mechanism 10 occurs when the chain 20 reaches a fully unwound position as shown in FIG. 1. The inertia caused by the aforesaid rapidly rotating members tends to wind the chain 20 on the chain winding drum 22 in a reverse direction. The chain stop 64 prevents winding the chain 20 in a reverse direction as the chain strikes the chain stop and is thereby prevented from further rotating movement.

In order to diminish both the first and second shocks incident to releasing the trip lever 63, one or both of the frictionally operated control release mechanisms of the invention may be employed to slow the speed of the rapidly rotating members. The first mechanism is indicated generally at 65 in FIG. 2. The mechanism includes a plurality (two being shown) of friction pads 66 each including a mounting post 70 extending therefrom which is inserted in a coil spring 71 thereby maintaining the friction pad 66 at the outer distal end of the coil spring. The coil spring 71 is housed in a cylindrical retainer cup 72 fastened to the back plate 12 of the hand brake mechanism.

In operation, a plurality of these friction pads are positioned radially adjacent a flat annular face on the radially extending flange 36. In FIG. 2 the radially extending flange 36 is shown in driving connection with the pressure nut 43 and the friction pads do not engage the annular face of the flange. In FIG. 3 the radially extending flange 36 has been disengaged from the pressure nut 43 by tripping lever 63 and the friction pads 66 have frictionally engaged the annular face of the now rapidly spinning radially extending flange 36. This frictional engagement results in a decrease in the speed of rotation of the radially extending flange 36, the pinion 25, the main gear wheel 24, and the chain winding drum 32.

The decrease in speed of the rotating parts lessens the shocks incident to the trip release and thereby prolongs the operational life of the mechanism. The frictional pads 66 may engage the radially extending flange 36 before the flange is fully disengaged from the pressure nut 43. The coil springs 71 increase the pressure exerted by the frictional pads 66 onto the radially extending flange 36 as the flange is moved laterally away from the pressure nut 43. The mounting rods 70 keep the frictional pads 66 in place at the free ends of the coil springs 71 while the radially extending flange is rapidly rotating. The annular retainers 72 in turn maintain the coil springs in position. A frictional pad 66, coil spring 71, and annular retainer 72 are shown more clearly in exploded view in FIG. 6.

A second controlled release mechanism is shown generally at 73 in FIG. 2. It may be utilized for the hand brake mechanism separately or in combination with the first mechanism 65. The second mechanism 73 includes a wave washer 74 which may be used singularly or in combination with flat washers 75–75 located on either side of the wave washer. The wave washer 74 is mounted around the outside (front) of pinion 25 and between radially extending flange 36 and main gear wheel 24. In FIG. 2 the wave washer 74 is shown in a disengaged position.

In FIG. 4 the radially extending flange 36 has been disengaged from the pressure nut 43, thereby moving in closer proximity to the main gear wheel 24. The wave washer is then compressed between the radially extending flange 36 and the main gear wheel 24 and the friction generated as a result of that compressive engagement between oppositely rotating members slows the rotation of both the members, thereby dissipating the shock incident to the release of the trip lever 63. The wave washer 74 and flat washer 75-75 mounted adjacent thereto are shown in exploded view in FIG. 5.

It will be understood that modifications and variations may be effected without departing from the scope of the novel concepts of the present invention, but it is understood that this application is limited only by the scope of the appended claims.

I claim:

1. In a railway car hand brake mechanism including in combination; a housing, a chain winding drum and a main gear wheel rotatably mounted on said housing, a hand wheel shaft rotatably bearingly mounted on said housing substantially centrally and at one end of said shaft and having a hand wheel receiving section at the other end externally of said housing, a ratchet wheel intermediate the ends of said shaft and rotatable therewith, a pawl in said housing cooperating with said ratchet wheel to hold it against reverse rotation, a pinion freely rotatable on said shaft and engaging said main gear wheel and having a radially extending flange rotatable conjointly therewith, a disengageable driving connection between said flange and said ratchet wheel, a trip cam rotatably mounted in said housing, tripbar means operable by said trip cam for cooperating with said flange for moving it to disengage said driving connection and permit said pinion to rotate freely to release said main gear for rotation in a brake releasing direction accompanied by release of said chain winding drum and a chain wound thereon, and an improvement comprising energy absorbing means for slowing the rotation of said radially extending flange when said brake mechanism is released by rotation of said trip cam.

2. In a railway car hand brake mechanism including in combination; a housing, a chain winding drum and a main gear wheel rotatably mounted on said housing, a hand wheel shaft rotatably bearingly mounted on said housing substantially centrally and at one end of said shaft and having a hand wheel receiving section at the other end externally of said housing, a ratchet wheel intermediate the ends of said shaft and rotatable therewith, a pawl in said housing cooperating with said ratchet wheel to hold it against reverse rotation, a pinion freely rotatable on said shaft and engaging said main gear wheel and having a radially extending flange rotatable conjointly therewith, a disengageable driving connection between said flange and said ratchet wheel, a trip cam rotatably mounted in said housing, trip bar means operable by said trip cam for cooperating with said flange for moving it to disengage said driving connection and permit said pinion to rotate freely to release said main gear wheel for rotation in a brake releasing direction accompanied by release of said chain winding drum and a chain wound thereon, and an improvement comprising a plurality of frictional pads mounted for resilient movement on said housing and positioned in evenly spaced relation around said hand shaft having a surface at a distal end thereof which frictionally engages said radially extending flange as said flange moves toward disengagement from said ratchet wheel.

3. The railway car hand brake mechanism of claim 2 further including at least one flat washer concentrically mounted with said wave washer and located between said wave washer and at least one of said members for increasing the frictional surface contact between same.

4. In a railway car hand brake mechanism having a housing adapted to be unrightly mounted, a chain winding drum member rotatably supported on a shaft journaled within said housing, a hand wheel in releaseable driven relationship with said drum mounted on an exteriorally projecting portion of a hand wheel shaft journaled within said housing, a releaseable coupling between said drum and said hand wheel mounted on said hand wheel shaft, trip means operatively interconnected with said coupling for tripping said brake, a chain anchored at one end to said drum and extending through the bottom of said housing with its opposite end connected to the brake rigging and a rotation stopping structure mounted within said housing so as to be impacted by at least one of said chain and said drum when said brake is tripped, the improvement comprising, compressible energy-absorbing means for frictionally engaging a flange member of said coupling interconnected with said drum as said hand wheel is released in driven relationship from said chain winding drum, said energy absorbing means including a wave washer positioned around said hand wheel shaft having a portion of said washer positioned in between said flange member of said coupling and said drum member which rotates in a direction opposite said flange, and said wave washer frictionally engaging said drum member simultaneously with said flange member when said flange is in an uncoupled position.

5. In a railway car hand brake mechanism having a housing adapted to be uprightly mounted, a chain winding drum member rotatably supported on a shaft journaled within said housing, a hand wheel in releaseable driven relationship with said drum mounted on an exteriorally projecting portion of a hand wheel shaft journaled within said housing, mounted on said hand wheel shaft, trip means operatively interconnected with said coupling for tripping said brake, the bottom of said housing with its opposite end connected to the brake rigging and a rotation stopping structure mounted within said housing so as to be impacted by at least one of said chain and said drum when said brake is tripped, the improvement comprising, a plurality of apertures horizontally positioned in the interior surface of said housing, in evenly spaced relation around said hand wheel shaft, a coil spring positioned in each said aperture coaxially therewith, and a friction pad located outwardly adjacent an external end of each said spring for engaging said flange member as it is moved toward an uncoupled position, said pad including a rod extending perpendicularly from the plane of said pad for mounting said pad on said spring by insertion of same into the central of said coil spring.

* * * * *